US011033779B2

(12) United States Patent
Hwang et al.

(10) Patent No.: US 11,033,779 B2
(45) Date of Patent: Jun. 15, 2021

(54) GOLF BALL WITH SYMMETRIC DIMPLE ARRANGEMENT OF SPHERICAL QUASI-OCTAHEDRON STRUCTURE

(71) Applicant: VOLVIK, INC., Chungcheongbuk-do (KR)

(72) Inventors: In-Hong Hwang, Gyeonggi-do (KR); Kyung-Ahn Moon, Seoul (KR)

(73) Assignee: Volvik, Inc., Chungcheongbuk-do (KR)

( * ) Notice: Subject to any disclaimer, the term of this patent is extended or adjusted under 35 U.S.C. 154(b) by 320 days.

(21) Appl. No.: 15/939,959

(22) Filed: Mar. 29, 2018

(65) Prior Publication Data

US 2019/0070465 A1 Mar. 7, 2019

(30) Foreign Application Priority Data

Sep. 5, 2017 (KR) ..... 10-2017-0113181

(51) Int. Cl.

| | |
|---|---|
| ***A63B 37/14*** | (2006.01) |
| ***A63B 37/00*** | (2006.01) |
| ***A63B 1/00*** | (2006.01) |
| *A63B 102/32* | (2015.01) |

(52) U.S. Cl.

CPC ..... *A63B 37/0006* (2013.01); *A63B 1/00* (2013.01); *A63B 37/002* (2013.01); *A63B 37/0018* (2013.01); *A63B 2102/32* (2015.10)

(58) Field of Classification Search

CPC ..... A63B 37/0006

See application file for complete search history.

(56) References Cited

U.S. PATENT DOCUMENTS

| | | | | |
|---|---|---|---|---|
| 4,560,168 A | | 12/1985 | Aoyama | 273/232 |
| 4,765,626 A | * | 8/1988 | Gobush | A63B 37/0004 473/383 |
| 5,009,428 A | * | 4/1991 | Yamagishi | A63B 37/0004 473/384 |
| 5,123,652 A | * | 6/1992 | Oka | A63B 37/0004 473/384 |

(Continued)

OTHER PUBLICATIONS

Office Action, dated Jan. 3, 2019 issued in Korean Patent Application No. KR 10-2017-0113181.

*Primary Examiner* — Eugene L Kim
*Assistant Examiner* — Matthew B Stanczak
(74) *Attorney, Agent, or Firm* — Harness, Dickey & Pierce, P.L.C.

(57) ABSTRACT

The present invention is a golf ball dividing method for symmetrically arranging dimples on a surface of a golf ball and a dimple arrangement method of arranging dimples along dividing lines based on sizes of dimples. The dimples having large diameters are effectively arranged on the deformed spherical triangle symmetrically over the entire surface of a sphere, so that it is possible to an effect of improving the flying stability and flight distance of the golf ball. Accordingly, it is possible to solve the problem of flying stability due to the lack of symmetry in the dimple arrangement method of the prior art for increasing an dimple area ratio by dividing the surface of the golf ball as a spherical octahedron and arranging dimples having large diameters, so that it is possible to improve a lift force to increase a flight distance and the flying stability of the golf ball.

12 Claims, 12 Drawing Sheets

(56) References Cited

U.S. PATENT DOCUMENTS

| | | | | | |
|---|---|---|---|---|---|
| 5,145,180 | A * | 9/1992 | Oka | A63B 37/0004 | 40/327 |
| 5,253,872 | A * | 10/1993 | Lemons | A63B 37/0004 | 40/327 |
| 5,415,410 | A * | 5/1995 | Aoyama | A63B 37/0004 | 473/382 |
| 5,518,246 | A * | 5/1996 | Moriyama | A63B 37/0004 | 473/384 |
| 5,562,552 | A | 10/1996 | Thurman | 473/379 | |
| 5,564,708 | A | 10/1996 | Hwang | 473/382 | |
| 5,575,477 | A | 11/1996 | Hwang | 473/379 | |
| 5,709,618 | A | 1/1998 | Hwang | 473/382 | |
| 5,735,756 | A * | 4/1998 | Stiefel | A63B 37/0004 | 473/382 |
| 5,957,786 | A * | 9/1999 | Aoyama | A63B 37/0004 | 473/379 |
| 5,957,787 | A * | 9/1999 | Hwang | A63B 37/0004 | 473/379 |
| 6,719,647 | B2 * | 4/2004 | Sajima | A63B 37/0004 | 473/378 |
| 6,821,215 | B2 * | 11/2004 | Sajima | A63B 37/0004 | 473/382 |
| 6,908,403 | B1 * | 6/2005 | Hwang | A63B 37/0003 | 473/383 |
| 2001/0027141 | A1 * | 10/2001 | Sajima | A63B 37/0004 | 473/378 |
| 2005/0113187 | A1 * | 5/2005 | Marotta | A63B 37/0003 | 473/371 |
| 2012/0015761 | A1 * | 1/2012 | Madson | A63B 37/0006 | 473/379 |
| 2013/0288827 | A1 * | 10/2013 | Hwang | A63B 37/0006 | 473/379 |

* cited by examiner

Dimple Diameter

| | |
|---|---|
| A : 0.2"~ 0.2025" | B : 0.1925"~ 0.195" |
| C : 0.18"~ 0.1825" | D : 0.17"~ 0.1725" |
| E : 0.165"~ 0.1675" | F : 0.13"~ 0.1325" |

51 : La.0°, Lo. 0°
52 : La. 0°, Lo. 60°
53 : La.0°, Lo. 120°
54 : La. 0°, Lo. 180°
55 : La.0°, Lo. 240°
56 : La. 0°, Lo. 300°
61 : La.36.52°, Lo. 90°
62 : La. 36.52°, Lo. 210°
63 : La.36.52°, Lo. 330°
71 : La. 19.27°, Lo. 30°
72 : La.19.27°, Lo. 150°
73 : La. 19.27°, Lo. 270°
81 : La.54.92°, Lo. 30°
82 : La. 54.92°, Lo. 150°
83 : La.54.92°, Lo. 270°
91 : La. 0°, Lo. 30°
92 : La.0°, Lo. 90°
93 : La. 0°, Lo. 150°
94 : La.0°, Lo. 210°
95 : La. 0°, Lo. 270°
96 : La.0°, Lo. 330°
99 : North Pole (La. 90°, Lo. 90°)

57 : La. 0° , Lo. 0°
58 : La. 0° , Lo. 60°
59 : La. 0° , Lo. 120°
60 : La. 0° , Lo. 180°
66 : La. 35.2643902° , Lo. 90°
67 : La. 35.2643902° , Lo. 210°
68 : La. 35.2643902° , Lo. 330°
76 : La. 19.471221° , Lo. 30°
77 : La. 19.471221° , Lo. 150°
78 : La. 19.471221° , Lo. 270°
86 : La. 54.73561° , Lo. 30°
87 : La. 54.73561° , Lo. 150°
88 : La. 54.73561° , Lo. 270°

GOLF BALL WITH SYMMETRIC DIMPLE ARRANGEMENT OF SPHERICAL QUASI-OCTAHEDRON STRUCTURE

CROSS-REFERENCE TO RELATED PATENT APPLICATION

This application claims the benefit of Korean Patent Application No. 10-2017-0113181, filed on Sep. 5, 2017 in the Korean Intellectual Property Office, the disclosure of which is incorporated herein in its entirety by reference.

FIELD

The present invention relates to a golf ball dividing method for symmetrically arranging dimples on a surface of a golf ball and a dimple arrangement method of arranging dimples along the dividing line segments.

BACKGROUND

With respect to golf balls, since dimples have a function of improving a lift force to increase a driving distance, the dimples on a surface of a golf ball are important in terms of aerodynamics. Since the dimples need to be symmetrically arranged on the surface of the sphere, that is, a golf ball, the dimples are arranged on a spherical polyhedron having a plurality of spherical polygons formed by dividing the surface of the sphere by using the great circles. As a spherical polyhedron used to the dividing line divide the surface of a sphere, examples of the spherical polyhedrons frequently used to arrange dimples of a golf ball may be a spherical tetrahedron having four spherical regular triangles, a spherical hexahedron having six spherical squares, a spherical octahedron having eight spherical regular triangles, a spherical dodecahedron having twelve regular pentagons, a spherical icosahedron having twenty spherical regular triangles, a spherical cubeoctahedron having six spherical squares and eight spherical regular triangles, an icosidodecahedron having twenty spherical regular triangles and twelve spherical regular pentagons, or the like.

In many golf balls among the currently used golf balls, 300 to 400 dimples are symmetrically arranged on a spherical polyhedron. In the dimple arrangement, since the number of dimples and the kind of dimple size are decreased, as a result, many lands (dimple-free areas) are formed. If there are many lands, the dimple area ratio of the surface of a sphere is decreased. Therefore, negatively affecting the lift force of golf ball, and thus, there is a problem in the flight distance becomes shortened.

Accordingly, there are many patents on a method of dividing the surface of a sphere and a dimple arrangement method for efficiently arranging the dimples on the surface of a sphere.

As an example, U.S. Pat. No. 4,560,168 discloses a dimple arrangement method of arranging dimples on a structure of a spherical icosidodecahedron obtained by connecting adjacent midpoints of the sides of triangles of a spherical icosahedron, which is formed by dividing the surface of a sphere with six great circles in such a manner that the dimples do not intersect the dividing lines. U.S. Pat. No. 5,562,552 discloses a method of arranging identical dimples on sixty spherical triangles formed by connecting a center of each spherical equilateral triangle and vertexes of each spherical equilateral triangle of a spherical icosahedron. U.S. Pat. No. 5,575,477 discloses a dimple arrangement method of arranging dimples in dimple share areas formed at a certain interval in each the dividing line constituting a spherical icosidodecahedron so as to intersect the dividing lines, so that an area ratio of dimples is increased to improve a flight distance. U.S. Pat. No. 5,564,708 discloses a method of locating each dimple in a dimple arrangement of six spherical equilateral triangles of a spherical cubeoctahedron in a divided structure where the surface of a sphere is dividing as a spherical octahedron or a spherical cubeoctahedron by great circles, six identical dimples are arranged around the center of each spherical equilateral triangle constituting the spherical cubeoctahedron, and each dimple is located in the six spherical equilateral triangles adjacent to the equator. U.S. Pat. No. 5,709,618 discloses a method of arranging dimples in spherical polygons formed by dividing the surface of a sphere into a spherical octahedron and setting the center of one spherical equilateral triangle constituting the spherical octahedron as a pole, and rotating the spherical octahedron having the same structure by 60 degrees about the pole. U.S. Pat. No. 5,735,756 discloses a method of arranging dimples within a circular area inscribing each spherical equilateral triangle formed by dividing the surface of a sphere into a spherical octahedron so that the dimples are filled in the circular area all the portions without overlapping the each circular boundary lines excluding the equator. And, U.S. Pat. No. 6,908,403 discloses a method of sub-dividing the surface of a sphere by great circles so that an existing spherical octahedron into a different spherical polyhedron and dimples are arranged in the spherical polygons of the spherical sub-divided polyhedron.

These patents relates to the methods of arranging dimples in the spherical polygons constituting a spherical polyhedron formed by dividing the surface of a sphere by great circles. In the surfaces of spheres having the same diameter, all the spherical polyhedrons formed by dividing by great circles are superimposed on each other. These polyhedrons seem to be similar to each other, but the polygons are different from each other in size, and thus, the dimple arrangement methods are different. Therefore, the dimple area ratio to the entire surface of the sphere are different from each other, and thus, the dimple arrangement methods are also different. Therefore, the aerodynamic characteristics of manufactured golf balls such as flight distance, trajectory, and flying stability are also different.

As a prior art, there are a method of improving symmetry of dimples by arranging the dimples with large diameter in a spherical equilateral triangle constituting a spherical octahedron and a method of minimizing lands by filling the lands with small-sized dimples having a diameter of 0.09 inches or less. However, in the above-described method using the dimples with large diameters, there is a disadvantage in that a large number of the lands are formed. In the above-described method using the dimples with small diameters, there are disadvantages in that a lift force improving effect is insignificant due to the small sizes of the dimples, it is difficult to produce a mold cavity, a golf ball which is not uniform in shape is manufactured due to deformed external appearance.

Therefore, if a dimple arrangement method having no problem in manufacturing golf balls, using only dimples with the lift force improving effect, minimizing the lands, and maximizing the dimple area ratio is developed, it can be expected that it is possible to further improve the flying stability and flight distance of the golf ball.

The patent documents and references cited herein are hereby incorporated by reference to the same extent as if each reference was individually and clearly identified by reference.

CITATION LIST

Patent Document

U.S. Pat. No. 4,560,168
U.S. Pat. No. 5,562,552
U.S. Pat. No. 5,575,477
U.S. Pat. No. 5,564,708
U.S. Pat. No. 5,709,618
U.S. Pat. No. 5,735,756
U.S. Pat. No. 6,908,403

SUMMARY

The present invention is to provide a golf ball which is a spherical quasi-octahedron, wherein the dimples and lands are symmetrically arranged and the land surface is minimized, so that the flight distance and the flying stability are improved.

Other objects and technical features according to the present invention will be more specifically described by the following detailed description of the invention, the claims, and the drawings.

In order to reduce the lands and to improve the dimple area ratio of the surface of a sphere when the dimples are arranged on the spherical octahedron formed by dividing the surface of the sphere by great circles in the prior art, according to the present invention, dimples are arranged on a spherical quasi-octahedron formed by dividing a surface of a sphere in a method of using the same positions being in contact with the equator as the great circles of the prior art and changing a position of a vertex of a deformed spherical triangle centered on a pole and positions of midpoints of sides of the deformed spherical triangle.

According to the present invention, the spherical quasi-octahedron includes eight deformed spherical triangles similarly to a spherical octahedron of the prior art.

According to the present invention, the deformed spherical triangles constituting the spherical quasi-octahedron are different from the spherical equilateral triangles constituting the spherical octahedron of the prior art.

In particular, according to the present invention, the positions of the dividing lines with respect to the equator are the same as the positions of the contact points of the great circles to the equator in the prior art. However, in order to achieve symmetry according to the diameters of the dimples having larger diameters, dimples are not arranged at the bisecting points of the sides of the deformed spherical triangle, two dimples are arranged to face each other across the midpoint and are arranged consecutively to be bisected by the side of the deformed spherical triangle, so that it is possible to improve symmetry of the dimples.

According to the present invention, the land of a common vertex of the four deformed spherical triangles is set to be equally quadrisected. The equally quadrisected land is different from the land of a common vertex of four spherical equilateral triangle of the spherical octahedron of the prior art where the land is not equally quadrisected but shifted in any one direction.

In addition, in the dimple arrangement according to the present invention, on a line segment connecting a bisecting point of each side of a deformed spherical triangle constituting a spherical quasi-octahedron and the vertices facing the bisecting point, a pair of dimples arranged around a dimple having the largest diameter at the center of the deformed spherical triangle to be in contact with the line segment, a dimple arranged to be bisected by the line segment, a pair of dimples arranged to be in contact with the line segment, and a dimple arranged to be bisected by the line segment are arranged in this order, and this dimple arrangement is repeated, so that it is possible to achieve a spherical quasi-octahedron capable of minimizing the number of lands and having excellent symmetry of the dimples having large diameters.

According to the present invention, it is possible to achieve a golf ball dividing method for symmetrically arranging dimples on a surface of a golf ball and a dimple arrangement method based on the dividing lines.

In the prior art, golf balls have problems in that dimples are arranged in a spherical octahedron formed by dividing a surface of a sphere by great circles, so that a large number of lands are formed and the arranged dimples having large diameters are difficult to have accurate symmetry due to the great circles.

On the contrary, in the golf ball dividing method and the dimple arrangement method based on the dividing line segments according to the present invention, the golf ball is divided as a spherical quasi-octahedron and the dimples are arranged, so that it is possible to obtain an effect that the dimples having large diameters are symmetrically arranged with respect to the equator of the sphere an effect that the lands are reduced overall but also having the symmetry, and thus, it is possible to obtain an advantage in manufacturing a golf ball having improved the flight distance and the flying stability.

In addition, the golf ball dividing method and the dimple arrangement method based on the dividing line segments according to the present invention, it is possible to realize dimple arrangement where the dimples and the lands are symmetrically arranged and the land surface is minimized even if the dimples with a size of 6 or less kind of diameters, so that it is possible to obtain an advantage in reducing costs of producing a mold cavity for producing a golf ball.

BRIEF DESCRIPTION OF THE DRAWINGS

FIG. 3 illustrates dimple arrangement with respect to line segments consecutively connecting one vertex and midpoints of sides facing the vertex. In particular, it can be understood that dimples (dimples D) having the fourth largest diameter are symmetrically arranged inside the deformed spherical triangles and the land where dimples are not arranged is equally quadrisected.

DETAILED DESCRIPTION

Figure 1:
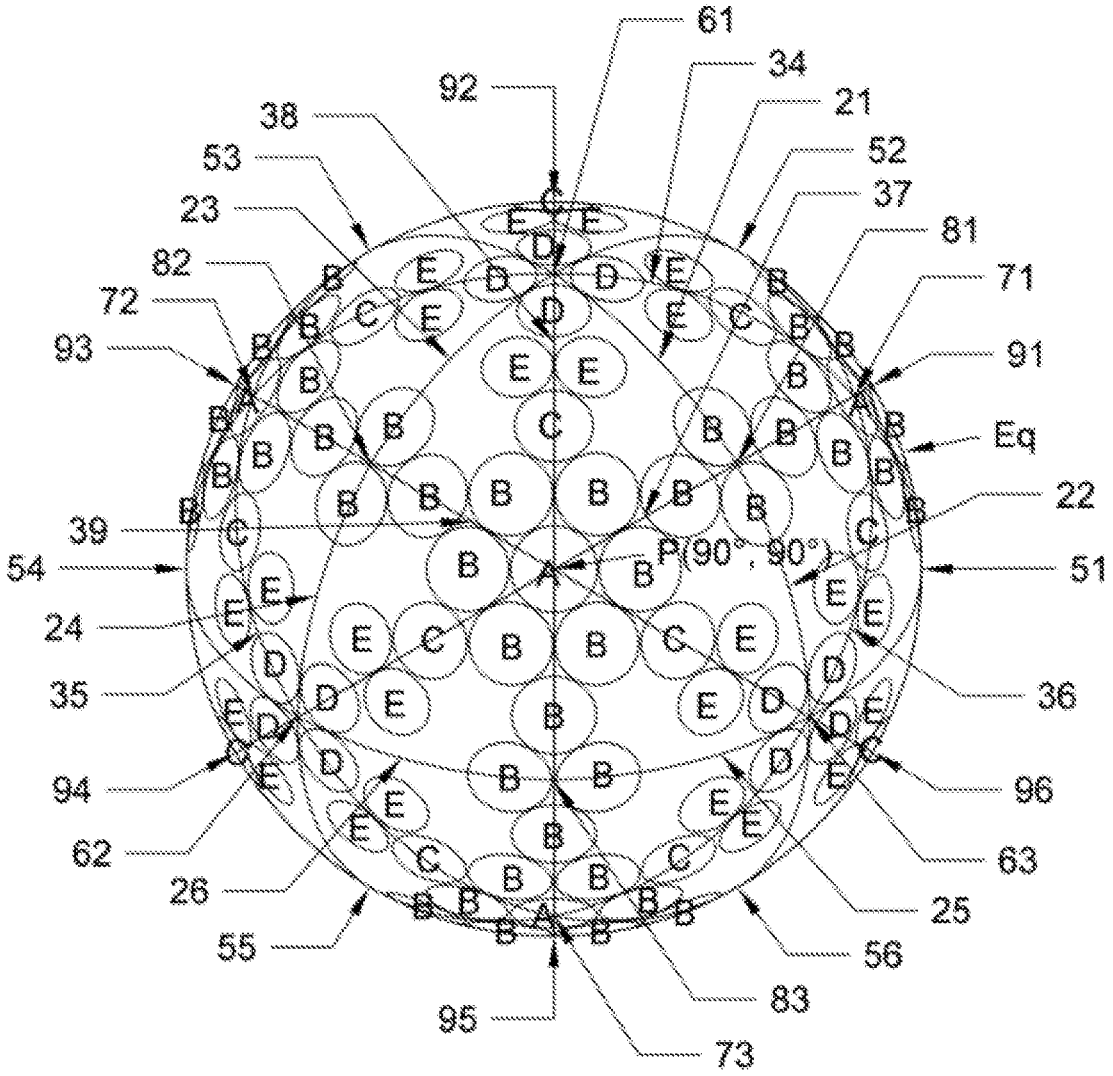
FIG. 1 illustrates dimple arrangement on a spherical quasi-octahedron according to the present invention, where the positions of the dividing line of a spherical quasi-octahedron are denoted by reference numerals, and dimples are arranged based on the sizes of dimples with respect to the dividing line segments in a divided structure.

The present invention provides a golf ball of which surface is divided as a spherical quasi-octahedron where dimples and lands are symmetrically arranged.

The spherical quasi-octahedron is configured to have a northern hemisphere and a southern hemisphere, the northern hemisphere is configured to have an arbitrary one point of the golf ball as a north pole, a deformed spherical triangle which has, as three sides, a first line segment connecting a line segment starting from a point 51(latitude: 0 degrees, longitude: 0 degrees) on an equator, passing through a point 63(latitude: 36.52 degrees, longitude: 330 degrees), and extending to a point 83(latitude: 54.92 degrees, longitude: 270 degrees) and a line segment starting from a point 54(latitude: 0 degrees, longitude: 180 degrees) on the equator, passing through a point 62(latitude: 36.52 degrees, longitude: 210 degrees), and extending to a point 83(latitude: 54.92 degrees, longitude: 270 degrees) at the connecting point 83, a second line segment connecting a line segment starting from a point 52(latitude: 0 degrees, longitude: 60 degrees) on the equator, passing through a point 61(latitude: 36.52 degrees, longitude: 90 degrees), and extending to a point 82(latitude: 54.92 degrees, longitude: 150 degrees) and a line segment starting from a point 55(latitude: 0 degrees, longitude: 240 degrees) on the equator, passing through a point 62(latitude: 36.52 degrees, longitude: 210 degrees), and extending to a point 82(latitude: 54.92 degrees, longitude: 150 degrees) at the connecting point 82, and a third line segment connecting starting from a point 53(latitude: 0 degrees, longitude: 120 degrees) on the equator, passing through a point 61(latitude: 36.52 degrees, longitude: 90 degrees), and extending to a point 81(latitude: 54.92 degrees, longitude: 30 degrees) and a line segment starting from a point 56(latitude: 0 degrees, longitude: 300 degrees) on the equator, passing through a point 63(latitude: 36.52 degrees, longitude: 330 degrees), and extending to a point 81 (latitude: 54.92 degrees, longitude: 30 degrees) at the connecting point 81 and includes the north pole at the center thereof, and three deformed spherical triangles, that is provided to have one side shared with the deformed spherical triangle and two sides bisected by the equator, and the southern hemisphere is configured so as to have four deformed spherical triangles in the same manner as the northern hemisphere.

The golf ball according to the present invention includes dimples having different diameters. The dimples having different diameters may be one or more dimples selected from a group including dimples A having a diameter of 0.2 to 0.2025 inches; dimples B having a diameter of 0.1925 to 0.195 inches; dimples C having a diameter of 0.18 to 0.1825 inches; dimples D having a diameter of 0.17 to 0.1725 inches; dimple E having a diameter of 0.165 to 0.1675 inches; and dimples F having a diameter of 0.13 to 0.1325 inches.

The dimple arrangement methods according to the present invention includes a method of arranging dimples on a line segment connecting each vertex of deformed spherical triangles and a bisecting point of a side facing the vertex, a method of arranging dimples on each side of a deformed spherical triangle, and a method of arranging dimples inside deformed spherical triangles so that the dimples are not in contact with any side.

First, as the dimple arrangement method on the side of the deformed spherical triangle, one dimple is arranged to be bisected by the line segment, and two dimples are arranged in adjacent with the bisected one dimple to face each other across the line segment. The dimple arrangement is repeated.

More specifically, one dimple D being located at an interior angle of the deformed spherical triangle, being bisected by a line segment connecting one vertex of the deformed spherical triangle and a bisecting point of a side facing the vertex, and being in contact with the vertex; two dimples E being in adjacent with the one dimple D and being in adjacent with each other with the line segment; one dimple C being in adjacent with the two dimple E and being bisected symmetrically by the line segment; two dimples B being in adjacent with the one dimple C and being in adjacent with each other with the line segment; one dimple A being in adjacent with the two dimples B, being located at the center of the deformed spherical triangle, and being bisected symmetrically by the line segment; other two dimples B being in adjacent with the one dimple A and being in adjacent with each other with the line segment; another dimple B being in adjacent with the other two dimples B and being bisected symmetrically by the line segment; and still other two dimples B being in adjacent with the another dimple B, being in adjacent with each other with an intersection point of the line segment and the side facing the vertex, and being bisected symmetrically by the side facing the vertex are arranged in this order.

Next, the dimples arranged on each side of the deformed spherical triangle include the dimples C that are arranged consecutively to be bisected by the side.

More specifically, two dimples D surrounding one vertex of the deformed spherical triangle and being in adjacent with each other with a side of the deformed spherical triangle; one dimple F being in adjacent with the two dimples D and being bisected symmetrically by the sides; one dimple E being in adjacent with the one dimple F and being bisected symmetrically by the side; one dimple B being in adjacent with the one dimple E, being in contact with the bisecting point of the side, and being bisected symmetrically by the side; another dimple B being in adjacent with the one dimple B, being in contact with the bisecting point of the side, and being bisected symmetrically by the side; another dimple E being in adjacent with the other dimple B and being bisected symmetrically by the side; another dimple F being in adjacent with the other dimple E and being bisected symmetrically by the side; and other two dimples being in adjacent with the other dimple F, surrounding another vertex of the deformed spherical triangle, and being in adjacent with each other with the side, the dimples are arranged in this order.

Finally, in a method of arranging dimples inside the deformed spherical triangle so as not to be in contact with any side, dimples C are used.

In addition, a dimple having the largest diameter is arranged at the center of the deformed spherical triangle, and two dimples having the second largest diameter are arranged to face each other with the bisecting point of the side of the deformed spherical triangle.

When the dimples are arranged by the dimple arrangement method according to the present invention described above, 290 to 320 dimples having large diameters can be arranged, and lands where dimples are not located are also symmetrically formed.

In particular, the land at a common vertex of the deformed spherical triangles is surrounded by the dimples D and is symmetrically divided by connecting the line segments of the sides of deformed spherical triangle and the connection line segments of line segments connecting a vertex of the deformed spherical triangle and a bisecting point of the side facing the vertex.

Hereinafter, a method of dividing the spherical quasi-octahedron according to the present invention and symmetrically arranging the dimples according to the present invention will be described in detail with reference to the drawings.

In general, a mold cavity for producing a cover with dimples of the golf ball is partitioned into northern and southern hemispheres, and the equator region becomes a mold parting line. In order to prevent this mold parting line from appearing, that is called seamless, dimples are intersected with a dividing line (equator) between the northern and southern hemispheres. Alternatively, the northern and southern hemispheres can be clearly distinguished by the dividing line so that the mold parting line is not appeared, and the dimples are arranged only inside the spherical equilateral triangle so that the dimples are arranged so as not intersected with other dividing lines. In the case where the dimples are intersected with the other dividing lines except for the equator, the sizes or positions of the dimples near the equator may be changed.

In this case, the dimples may not be symmetrically arranged with the dividing lines forming the spherical equilateral triangle as boundaries, or a large number of the lands where the dimples are not arranged may be formed, so that the flight distance and flying stability of the golf ball are reduced.

In general, as a method of dividing the surface of a sphere as a spherical octahedron, a method of arranging a small number of types of dimples having large diameters and similar sizes in spherical equilateral triangles constituting a spherical octahedron inevitably has the above problems.

In order to eliminate the above problems and to arrange the dimples having large diameters symmetrically, it is necessary to change and adjust the position of the dividing line from the existing position. The triangle formed by changing the position of the dividing line becomes a deformed triangle (deformed spherical triangle) different from the existing spherical equilateral triangle.

Figure 9:
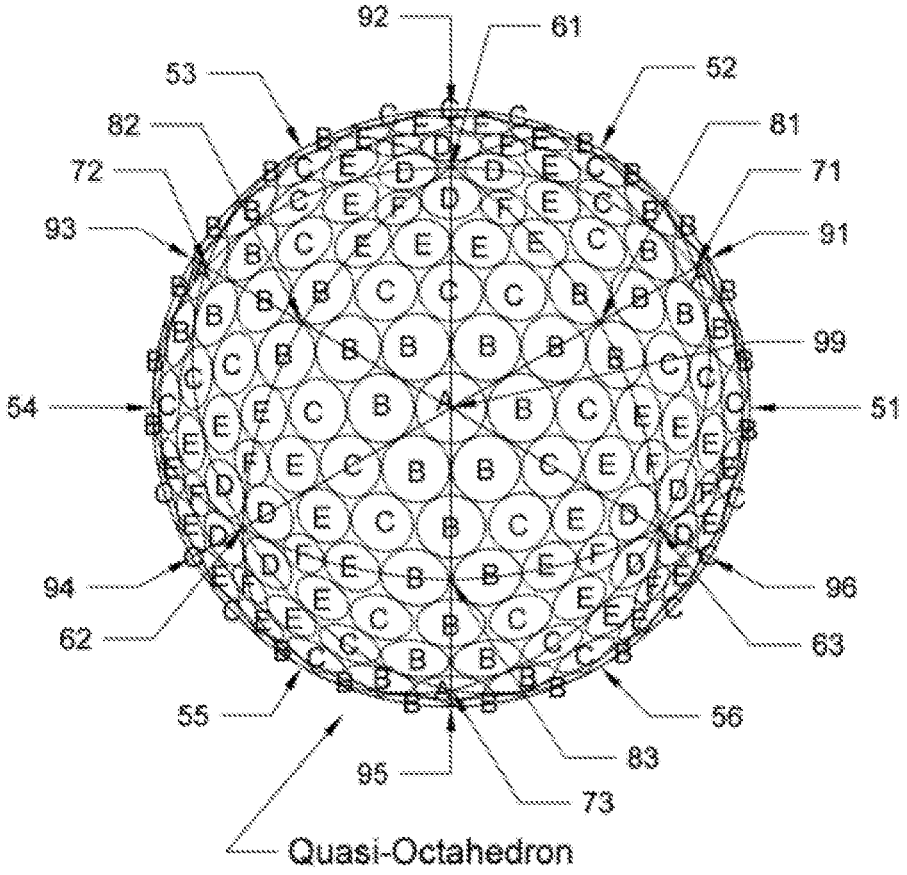
FIG. 9 illustrates a dimple arrangement where the dividing line segments are formed to be different from the dividing line segments of a sphere formed by great circles of a spherical octahedron of the prior art, a surface of the sphere is divided as a spherical quasi-octahedron, and symmetry positions on the dividing lines for dimple arrangement based on the sizes and positions through which the different dividing line segments pass are illustrated together with the overall size-based dimple arrangement in the northern hemisphere on the equator.

The spherical quasi-octahedron is configured to have a northern hemisphere and a southern hemisphere, the northern hemisphere is configured to have an arbitrary one point of the golf ball as a north pole, that is, Point 99 (latitude: 90 degrees, longitude: 90 degrees) referring to FIG. 9, a deformed spherical triangle which has, as three sides, a connection line segment connecting a line segment starting from a point 51(latitude: 0 degrees, longitude: 0 degrees) on an equator, passing through a point 63(latitude: 36.52 degrees, longitude: 330 degrees), and extending to a point 83(latitude: 54.92 degrees, longitude: 270 degrees) and a line segment starting from a point 54(latitude: 0 degrees, longitude: 180 degrees) on the equator, passing through a point 62(latitude: 36.52 degrees, longitude: 210 degrees), and extending to a point 83(latitude: 54.92 degrees, longitude: 270 degrees) connecting at the point 83, another connection line segment connecting a line segment starting from a point 52(latitude: 0 degrees, longitude: 60 degrees) on the equator, passing through a point 61(latitude: 36.52 degrees, longitude: 90 degrees), and extending to a point 82(latitude: 54.92 degrees, longitude: 150 degrees) and a line segment starting from a point 55(latitude: 0 degrees, longitude: 240 degrees) on the equator, passing through a point 62(latitude: 36.52 degrees, longitude: 210 degrees), and extending to a point 82(latitude: 54.92 degrees, longitude: 150 degrees) connecting at the point 82, and still another connection line segment connecting a line segment starting from a point 53(latitude: 0 degrees, longitude: 120 degrees) on the equator, passing through a point 61(latitude: 36.52 degrees, longitude: 90 degrees), and extending to a point 81(latitude: 54.92 degrees, longitude: 30 degrees) and a line segment starting from a point 56(latitude: 0 degrees, longitude: 300 degrees) on the equator, passing through a point 63(latitude: 36.52 degrees, longitude: 330 degrees), and extending to a point 81 (latitude: 54.92 degrees, longitude: 30 degrees) connecting at the point 81 and includes the north pole at the center thereof, three deformed spherical triangles, each of which is provided to have one side shared with the deformed spherical triangle and another two sides bisected by the equator, and the southern hemisphere is configured so as to have four deformed spherical triangles in the same manner as the northern hemisphere (a total of eight deformed spherical triangles are formed).

In order to realize the dimple arrangement method according to the present invention on the spherical quasi-octahedron, it is necessary to sub-dividing the deformed spherical triangles.

Referring to FIG. 9, first, a line segment connecting a vertex of the deformed spherical triangle formed at the center of the sphere and a midpoint (the same point as the connection point of the two line segments described above) of the side facing the vertex is formed.

A line segment starting from a point 91 (latitude: 0 degrees, longitude: 30 degrees) of the equator, passing through a bisecting point 81 (latitude: 54.92 degrees, longitude: 30 degrees, the connection point of two line segments) of a line segment constituting a side of a central deformed spherical triangle, passing through a point 99 (latitude: 90 degrees, longitude: 90 degrees) as a pole of the sphere, passing through a point 62 (latitude: 36.52 degrees, longitude: 210 degrees) as a vertex, and a point 94 (latitude 0 degrees, longitude: 210 degrees), and dividing the sphere is provided, a line segment starting from a point 95 (latitude: 0 degrees, longitude: 270 degrees) of the equator, passing through a bisecting point 83 (latitude: 54.92 degrees, longitude: 270 degrees; the connection point of two line segments) of a line segment constituting a side of the central deformed spherical triangle, passing through the point 99 (latitude: 90 degrees, longitude: 90 degrees) as the pole of the sphere, passing through a point 61 (latitude: 36.52 degrees, longitude: 90 degrees) as a vertex, and a point 92 (latitude 0 degrees, longitude: 90 degrees), and dividing the sphere is provided, and a line segment starting from a point 93 (latitude: 0 degrees, longitude: 150 degrees) of the equator, passing through a bisecting point 82 (latitude: 54.92 degrees, longitude: 150 degrees; the connection point of two line segments) of a line segment constituting a side of the central deformed spherical triangle, passing through the point 99 (latitude: 90 degrees, longitude: 90 degrees) as the pole of the sphere, passing through a point 63 (latitude: 36.52 degrees, longitude: 330 degrees) as a vertex, and a point 96 (latitude 0 degrees, longitude: 330 degrees), and dividing the sphere is provided. The sphere is divided again by these line segments.

The three deformed spherical triangles being in contact with the equator are formed in the same manner as described above, except that the two line segments constituting the side of the deformed spherical triangle closer to the equator are divided into the northern and southern hemispheres. Therefore, the bisecting points of the two sides being in contact with the equator are located on the equator.

A line segment starting from a point 51 (latitude: 0 degrees, longitude: 0 degrees) being in contact with the equator, passing through a point 71 (latitude: 19.27 degrees, longitude: 30 degrees) as the center of a deformed spherical triangle crossing the equator, and extending to a point 61 (latitude: 36.52 degrees, longitude: 90 degrees) as a vertex is provided, a line segment starting from a point 54 (latitude: 0 degrees, longitude: 180 degrees) being in contact with the equator, passing through a point 72 (latitude: 19.27 degrees, longitude: 150 degrees) as the center of another deformed spherical triangle crossing the equator, and extending to the point 61 (latitude: 36.52 degrees, longitude: 90 degrees) as a vertex is provided, and a connection line segment connecting the two line segments at the point 61 as the vertex is provided.

A line segment starting from a point 52 (latitude: 0 degrees, longitude: 60 degrees) being in contact with the equator, passing through a point 71 (latitude: 19.27 degrees, longitude: 30 degrees) as the center of a deformed spherical triangle crossing the equator, and extending to a point 63 (latitude: 36.52 degrees, longitude: 330 degrees) as a vertex is provided, a line segment starting from a point 55 (latitude: 0 degrees, longitude: 240 degrees) being in contact with the equator, passing through a point 73 (latitude: 19.27 degrees, longitude: 270 degrees) as the center of another deformed spherical triangle crossing the equator, and extending to the point 63 (latitude: 36.52 degrees, longitude: 330 degrees) as a vertex is provided, and a connection line segment connecting the two line segments at the point 63 as the vertex is provided.

A line segment starting from a point 53 (latitude: 0 degrees, longitude: 120 degrees) being in contact with the equator, passing through a point 72 (latitude: 19.27 degrees, longitude: 150 degrees) as the center of another deformed spherical triangle crossing the equator, and extending to a point 62 (latitude: 36.52 degrees, longitude: 210 degrees) as a vertex is provided, a line segment starting from a point 56 (latitude: 0 degrees, longitude: 330 degrees) being in contact with the equator, passing through a point 73 (latitude: 19.27 degrees, longitude: 270 degrees) as the center of still another deformed spherical triangle crossing the equator, and extending to the point 62 (latitude: 36.52 degrees, longitude:

210 degrees) as a vertex is provided, and a connection line segment connecting the two line segments at the point 62 as the vertex is provided.

The three connection line segments formed in such a manner as described above become dividing lines subdividing the deformed spherical triangle into six spherical triangles as line segments linearly connecting the vertices of the deformed spherical triangles closer to the equator and the bisecting points facing the vertices through the centers of the deformed spherical triangles.

Figure 2:
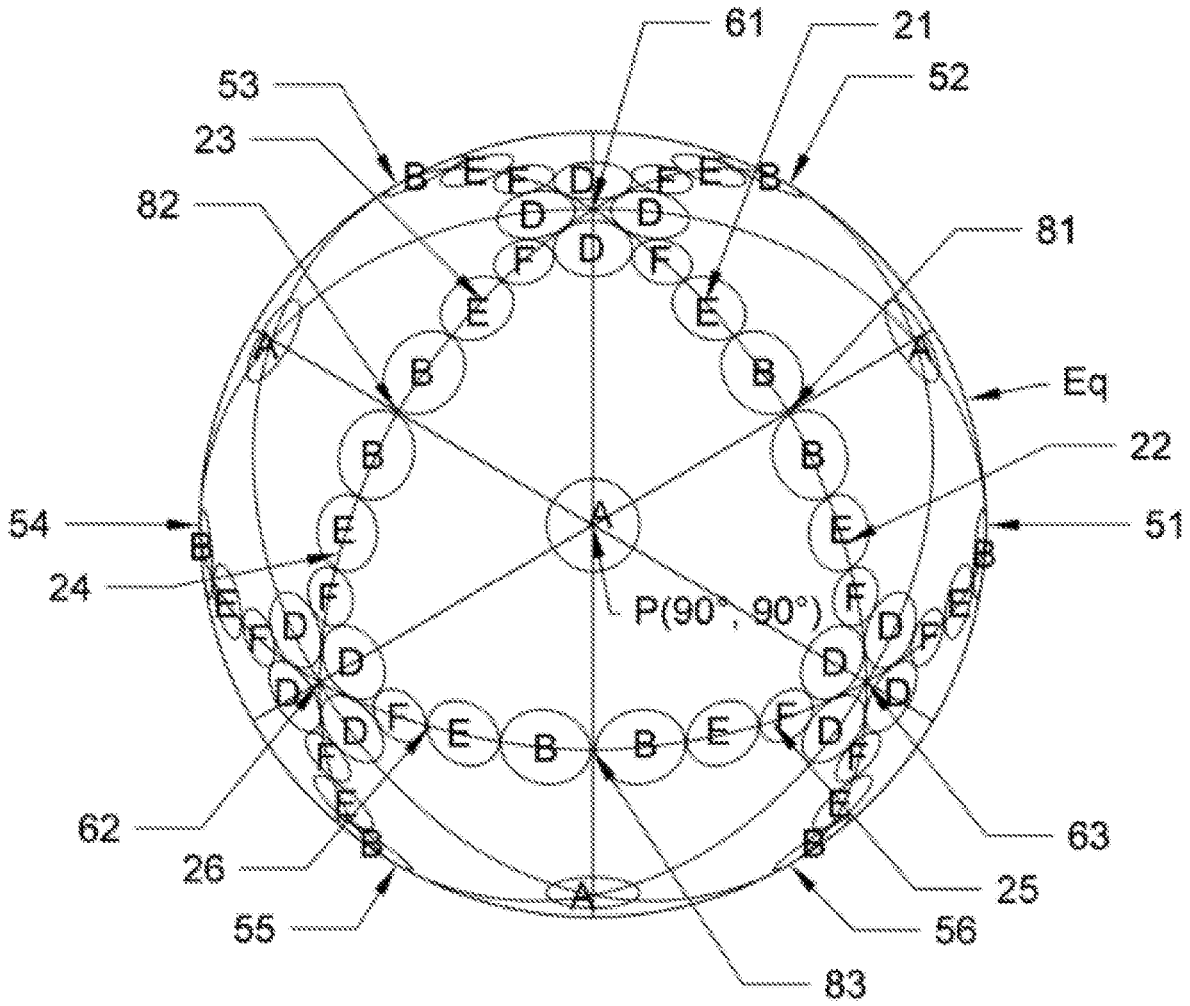
FIG. 2 illustrates dimple arrangement according to the present invention where dimples are arranged to face each other at midpoints (connection points) of sides of a deformed spherical triangle having sides formed by start points of a dividing line segment and a connection point of two dividing line segments, and symmetrically-dimples are arranged consecutively to be bisected by the dividing line segments. And a dimple A having the largest diameter is arranged at the center of the deformed spherical triangle, and lands where dimples are not arranged at the vertex of the spherical triangle have symmetry with respect to the dividing line segments.

FIG. 2 illustrates a dimple arrangement method on deformed spherical triangles constituting the spherical quasi-octahedron as described above.

In FIG. 2, a dimple A (Diameter: 0.2 inches to 0.2025 inches) having the largest diameter is arranged at each of the centers (Point 99, Point 71, Point 72, Point 73 in FIG. 9) of the deformed spherical triangles constituting the spherical quasi-octahedron.

In the deformed spherical triangle centered on the pole (Point 99, Point 71, Point 72, and Point 73 in FIG. 9), dimples B (Diameter: 0.1925 inches~0.195 inches) having the second largest diameter are arranged to be bisected by the dividing line with the bisecting point (connection point of the two line segments) of the side facing the vertex of the deformed spherical triangle so that the center of the dimple B is located on the dividing line constituting the side, and the dimples B are arranged to face each other on the side with the bisecting point (Point 81, Point 82, Point 83) of the side.

In the deformed spherical triangle which the equatorial passes through, dimples B (Diameter: 0.1925 inches-0.195 inches) having the second largest diameter are arranged to be bisected by the dividing line with the bisecting point (Point 51, Point 52, Point 53, Point 54, Point 55, and Point 56) of the side existing on the equator in the northern and southern hemispheres.

Dimples E (Diameter: 0.165 inches to 0.1675 inches) having the fifth largest diameter toward the vertex are arranged consecutively to the dimple E to be bisected by the dividing line constituting the side, and the dimples E on the side are arranged to face each other with the bisecting point (Point 81, Point 82, and Point 83) of the side.

Consecutively, a dimple F (Diameter: 0.13 inches to 0.1325 inches) having the smallest diameter is arranged in the same manner.

In the same manner as described above, with respect to the deformed spherical triangle where the bisecting point of the side is in contact with the equator, the dimples with the same configuration are bisected by the dividing line and arranged consecutively.

Figure 3:
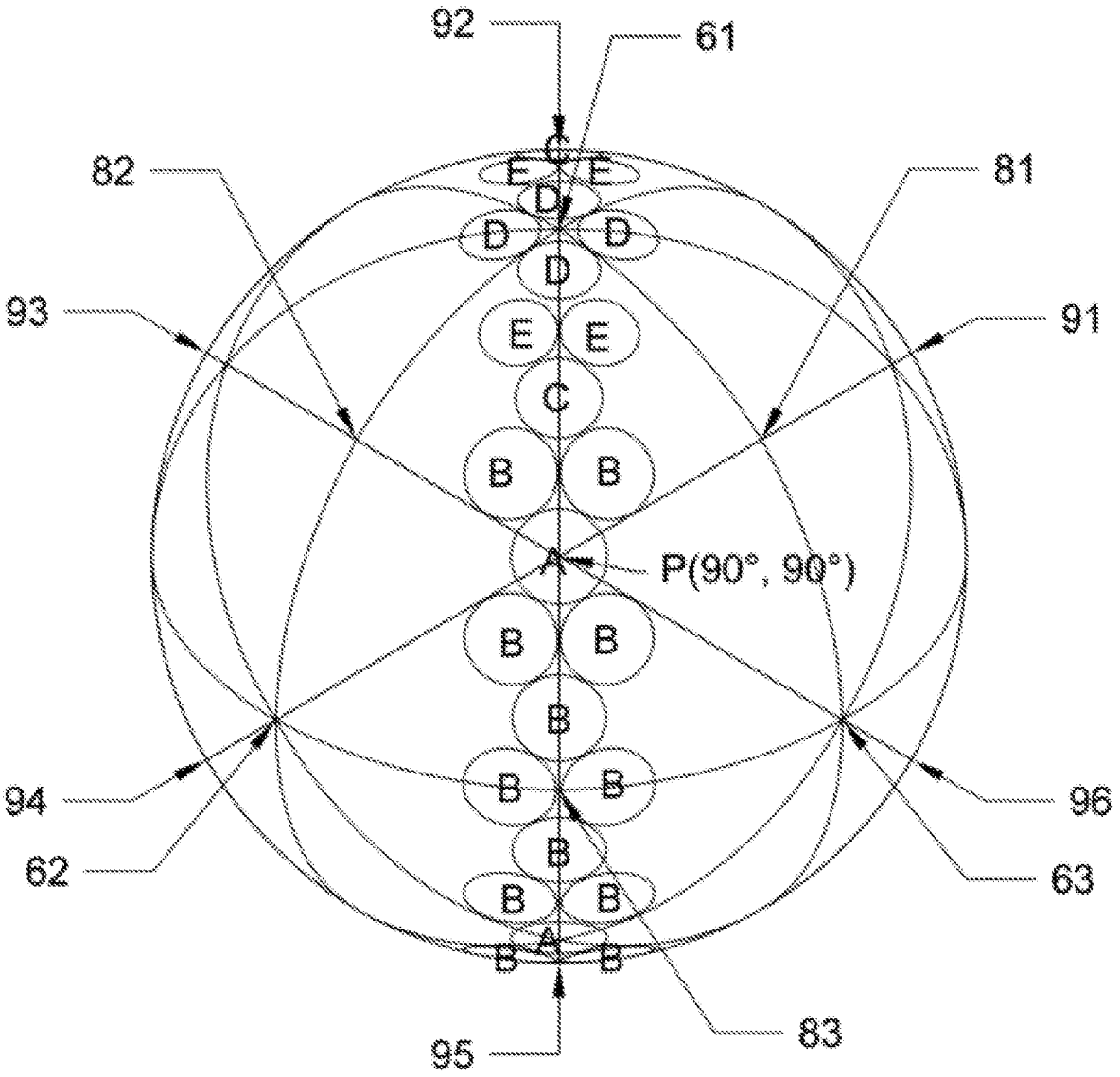
FIG. 3 illustrates a dimple arrangement on the line segment connecting each vertex of the deformed spherical triangle constituting the spherical quasi-octahedron according to the present invention and the midpoint of the side facing the vertex. A dimple A having the largest diameter is arranged at the center of the deformed spherical triangle, two dimples having the same size are arranged to face each other with the dividing line segment, and a dimple is arranged to be bisected by the line segment, and two dimples having the same size are arranged to face each other across the dividing line segment, and this dimple arrangement is repeated.

FIG. 3 illustrates the dimple arrangement with respect to a connection line segment connecting Point 92 (latitude: 0 degrees, longitude: 90 degrees) and Point 95 (latitude: 0 degrees, longitude: 270 degrees) and connecting a vertex of the deformed spherical triangle and a bisecting point of a side facing the vertex.

Referring to FIG. 3, with respect to the position and size of a dimple A, the dimple A is arranged at the center of the deformed spherical triangle, as described above. Dimples B having the second largest diameter from the center to the side are arranged side by side next to the dimple A with a connection line segment connecting the vertex and the bisecting point of the side facing the vertex, a dimple B with the second largest diameter is arranged on the connection line segment to be bisected, and dimples B having the second largest diameter are arranged side by side with the line segment connecting the vertex and the bisecting points of sides facing the vertex. The two dimples B are the same as the dimples B facing each other with each of the bisecting point (Point 81, Point 82, and Point 83 in FIGS. 2 and 3) of the side of the deformed spherical triangle. In the direction from the position of the dimple A at the center of the deformed spherical triangle to the vertex (Point 61 in FIG. 3), two dimples B are arranged next to the dimple A side by side with the line segment connecting the vertex and the bisecting points of the side facing the vertex, a dimple C (Diameter: 0.18 inches to 0.1825 inches) having the third largest diameter toward the vertex is arranged on the line segment to bisected by the line segment, two dimples E are arranged side by side next to the dimple C, and a dimple D (Diameter: 0.17 inches to 0.1725 inches) having the fourth largest diameter is arranged immediately before the vertex.

In the dimple arrangement with respect to the line segment connecting each vertex of the deformed spherical triangle and a bisecting point facing the vertex, one dimple is arranged to be bisected by the line segment, the next two dimples are arranged side by side across the line segment, and another one dimple is arranged to be bisected by the line segment. Such dimple arrangement is alternately performed consecutively.

Therefore, in a northern hemisphere, with respect to one dimple at one side of the equator, two dimples are arranged side by side at the other side of the equator with the line segment.

Figure 4:
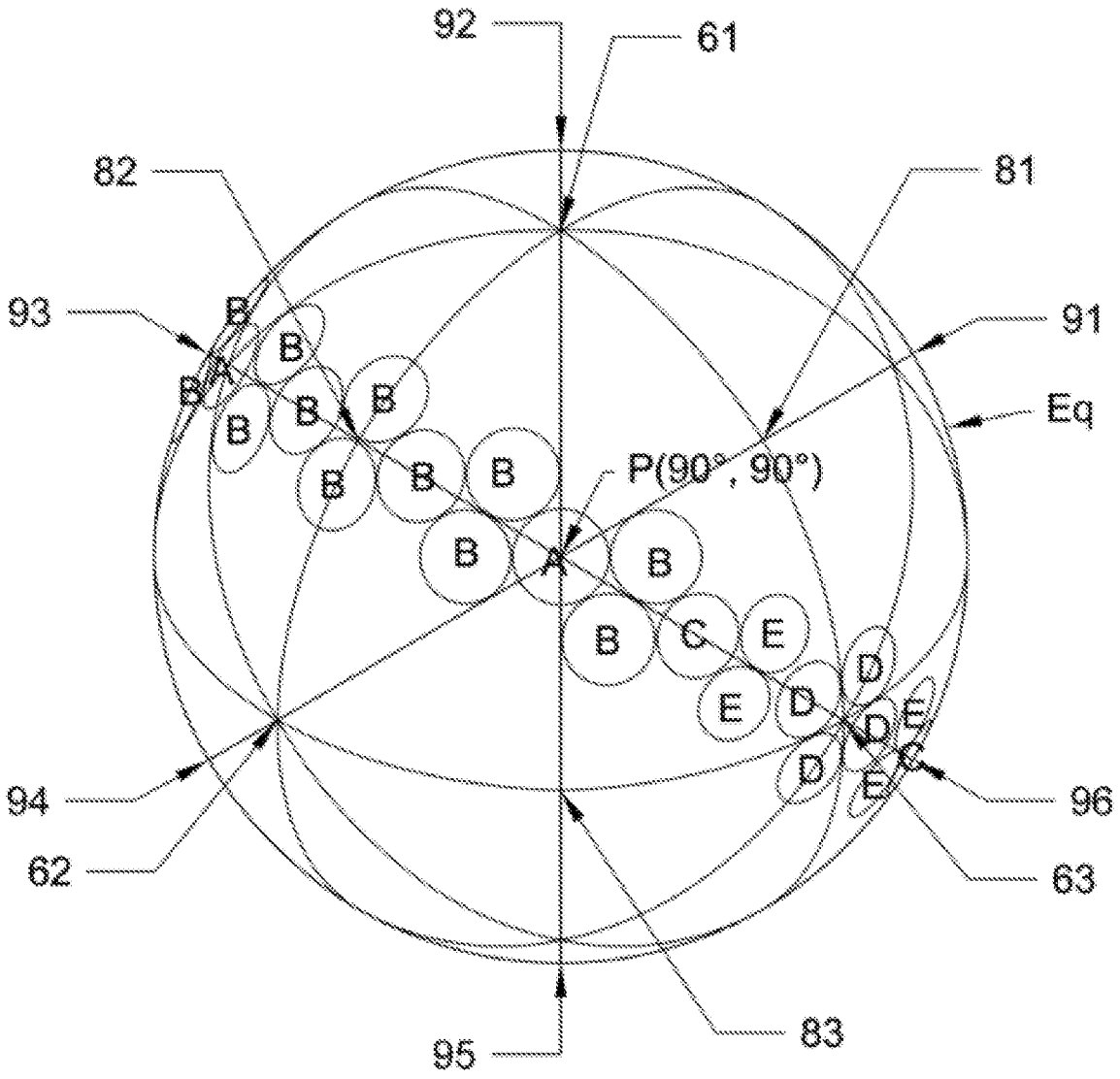
FIG. 4 illustrates dimple arrangement in the same form as FIG. 3 where dimples are arranged on a line segment connecting a vertex and a midpoint (connection point) of a side of the deformed spherical triangle facing the vertex in a different direction.
Figure 5:
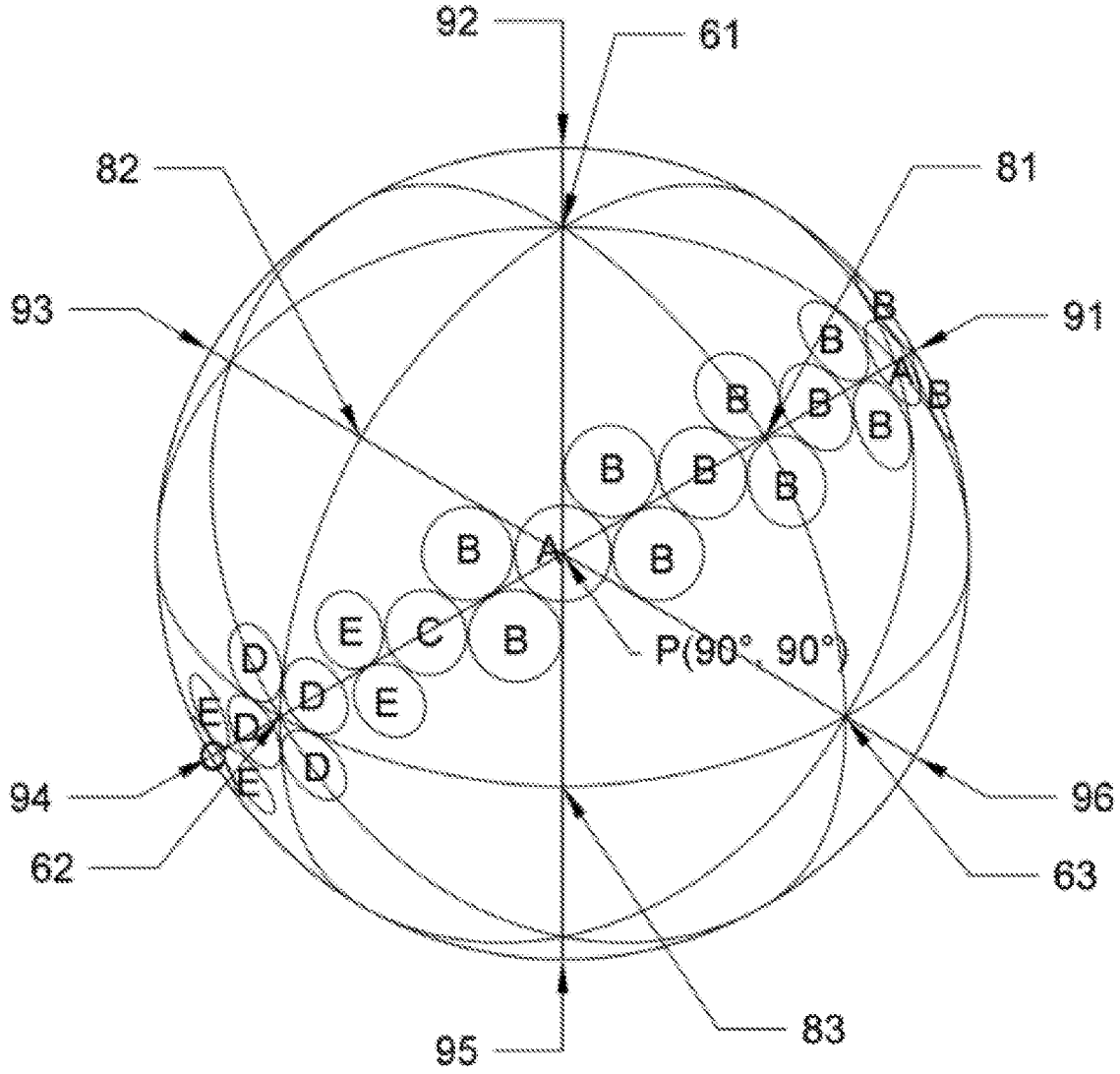
FIG. 5 illustrates dimple arrangement in the same form as FIG. 3 where dimples are arranged on a line segment connecting a vertex and a midpoint (connection point) of a side of the deformed spherical triangle facing the vertex in a different direction.

FIG. 4 is another example of dimple arrangement with respect to a line segment connecting a vertex of the deformed spherical triangle and a bisecting point of a side facing the vertex, where dimples are arranged with respect to the line segment connecting Point 96 (latitude: 0 degrees, longitude: 330 degrees) and Point 93 (latitude: 0 degrees, longitude: 150 degrees). The dimple arrangement illustrated in FIG. 4 is the same as the dimple arrangement illustrated in FIG. 3.

Figure 6:
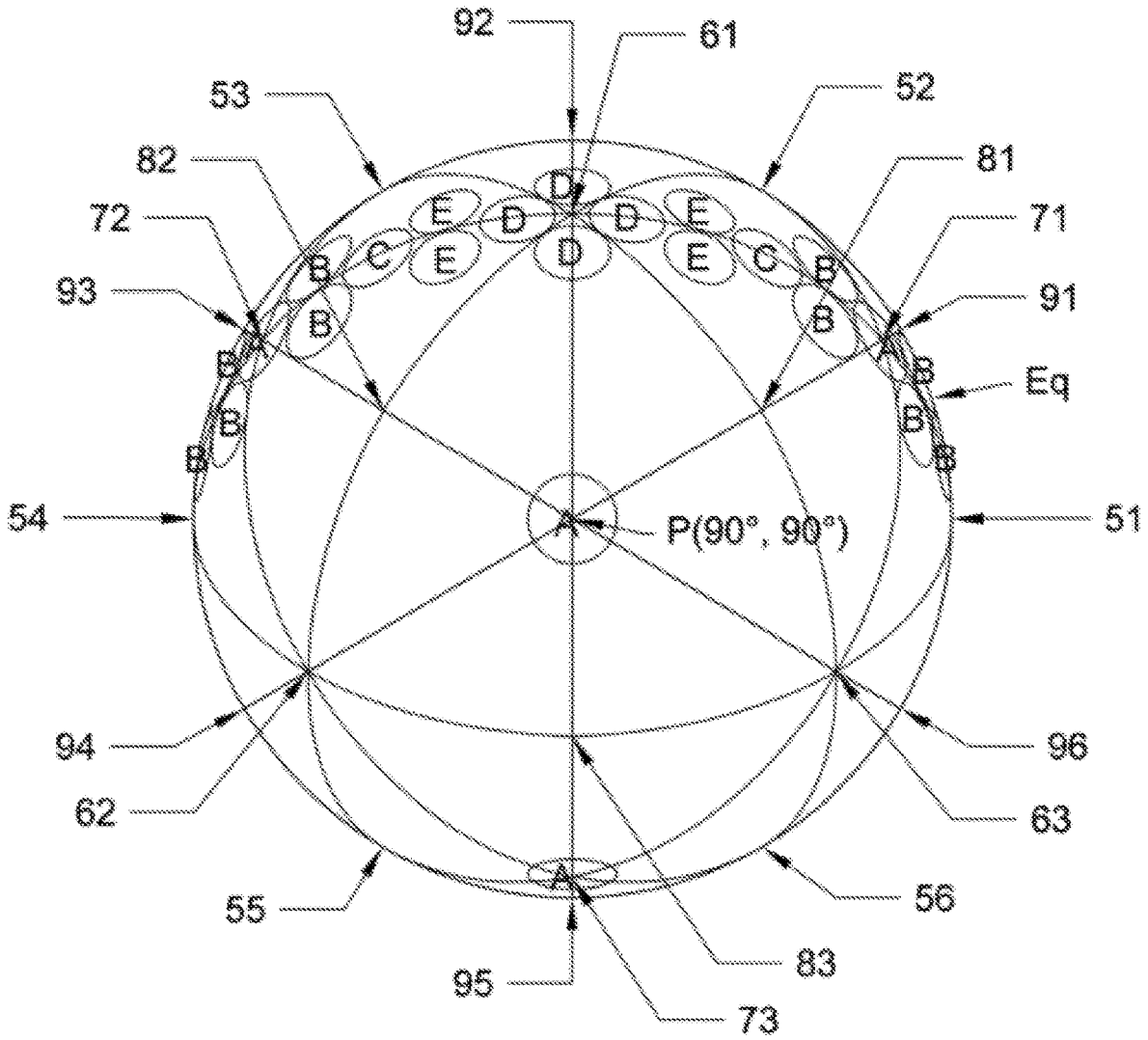
FIG. 6 illustrates dimple arrangement in the same form as FIG. 3 where dimples are arranged on a line segment connecting a vertex and a midpoint (connection point) of a side of the deformed spherical triangle facing the vertex in a different direction. A dimple A having the largest diameter is arranged at the center of each spherical triangle, and dimples are arranged based on the sizes of the dimples in two deformed spherical triangles where the midpoints of two sides are in contact with the equator, one vertex is shared, and the two deformed spherical triangles are divided by the equator.

FIG. 6 illustrates the dimple arrangement with respect to a line segment connecting a vertex of the deformed spherical triangle divided by the equator and each bisecting points (Point 51, Point 52, Point 53, Point 54, Point 55, and Point 56 existing on the equator in FIG. 6) of the side facing the vertex.

The dimple arrangement method illustrated in FIG. 6 is the same as the dimple arrangement method illustrated in FIG. 3.

As can be seen in FIG. 6, four D dimples are symmetrically arranged near the Point 61 (latitude: 36.52 degrees, longitude: 90 degrees) at the same distance away from the point 61, and the dimples are located inside each deformed spherical triangle. Accordingly, it can be understood that the land surrounded by the dimples D is also equally quadrisected into quadrants by the dividing lines.

Figure 7:
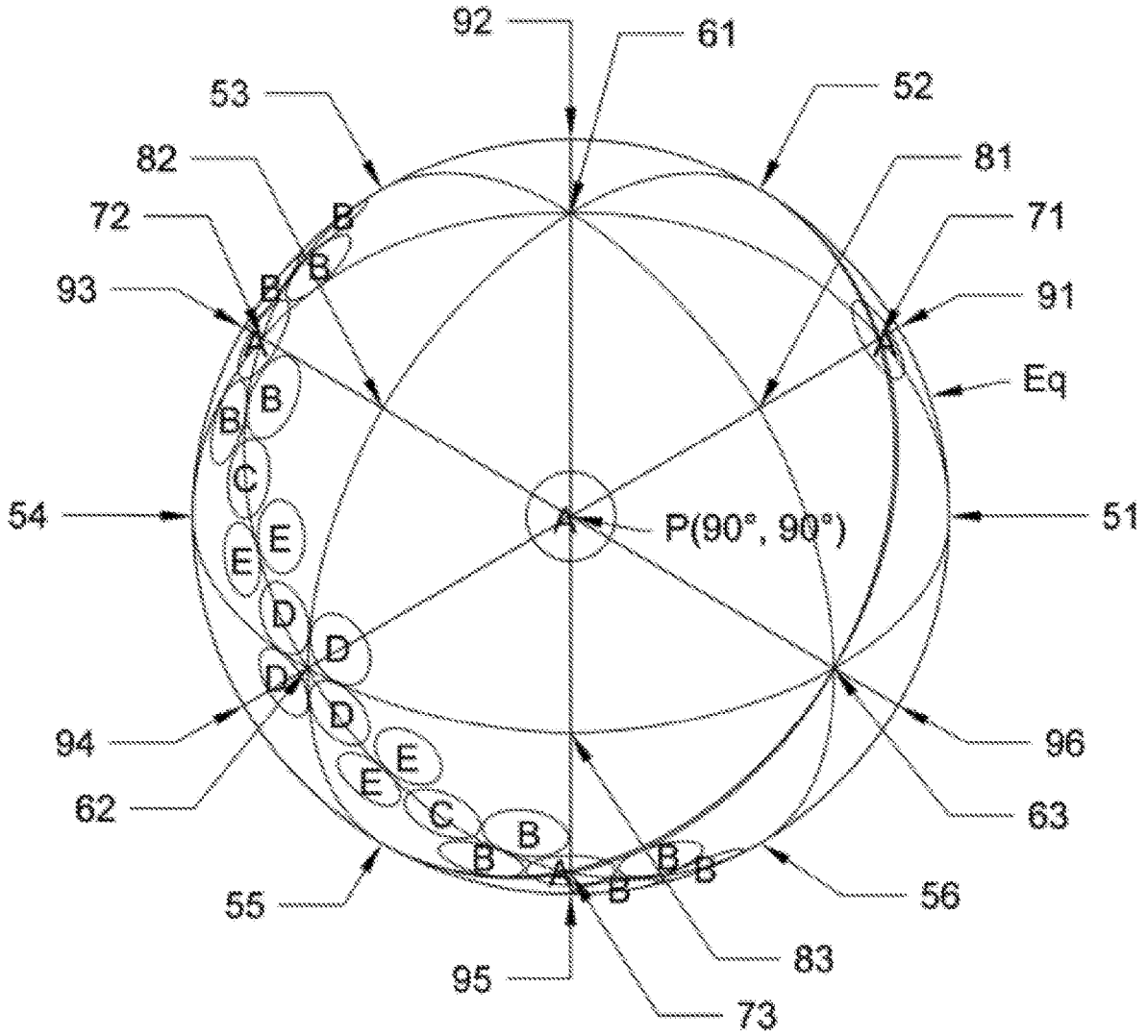
FIG. 7 illustrates dimple arrangement on the line segment connecting a vertex and a midpoint (connection point) of a side of the deformed spherical triangle facing the vertex at a position different from that of FIG. 6. In the dimple arrangement on the dividing line passing through the common vertex at the position of one point, the dimples are arranged based on the sizes of the dimples in the same manner as FIG. 6.

FIG. 7 illustrates dimple arrangement at another position near the equator with respect to a connection line segment connecting a vertex of the deformed spherical triangle divided by the equator and each bisecting point (Point 51, Point 52, Point 53, Point 54, Point 55, and Point 56 existing on the equator in FIG. 7) of the side facing the vertex. The dimple arrangement method illustrated in FIG. 7 is the same as the dimple arrangement method illustrated in FIG. 3. Similarly to FIG. 6, four D dimples near Point 62 (latitude: 36.52 degrees, longitude: 210 degrees) are symmetrically located at the same distance away from a point 62. It is seen that the land formed on the aforementioned area is also surrounded by four D dimples and is equally quadrisected by dividing lines.

Figure 8:
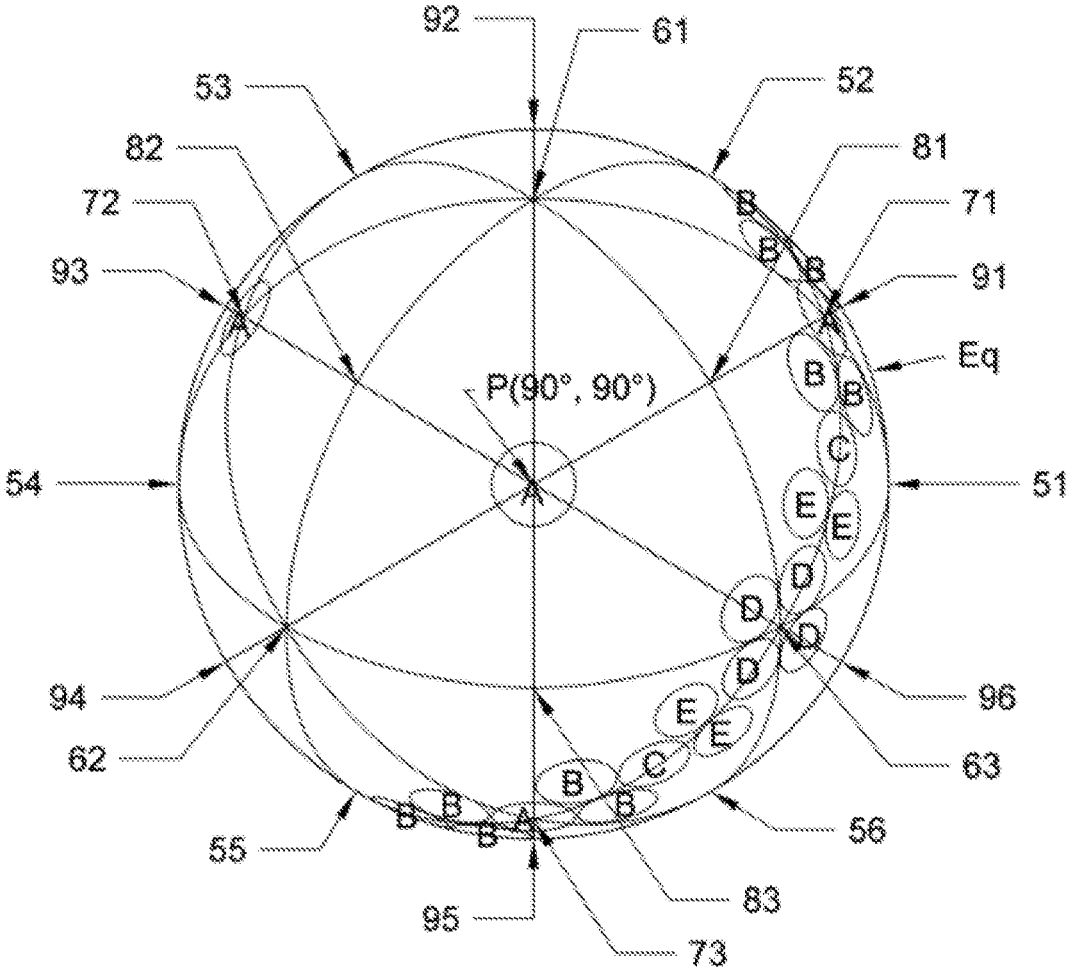
FIG. 8 illustrates dimple arrangement on the line segment connecting a vertex and a midpoint (connection point) of a side of the deformed spherical triangle facing the vertex at another position different from that of FIG. 6. In the dimple arrangement on the dividing line passing through the common vertex at the position of one point, the dimples are arranged based on the sizes of the dimples in the same manner as FIG. 6.

FIG. 8 illustrates dimple arrangement at still another position near the equator with respect to a line segment connecting a vertex of the deformed spherical triangle divided by the equator and each bisecting point (Point 51, Point 52, Point 53, Point 54, Point 55, and Point 56 existing on the equator in FIG. 8) of the side facing the vertex. The dimple arrangement method illustrated in FIG. 8 is the same as the dimple arrangement method illustrated in FIG. 3. Similarly to FIGS. 6 and 7, the four D dimples near Point 63 (latitude: 36.52 degrees, longitude: 330 degrees) are symmetrically located at the same distance away from the point 63. It is seen that the land formed on the aforementioned area is also surrounded by four D dimples and is equally quadrisected by the dividing lines.

FIG. 1 illustrates the dimple arrangement with respect to each line segment connecting each vertex of the deformed spherical triangle and a bisecting point of a side facing the vertex.

In FIG. 1, the sizes and positions of the arranged dimples are illustrated based on sizes of the dimples, and the dimples are exactly symmetrical arranged.

The dimple arrangement method on the spherical quasi-octahedron configured with deformed spherical triangles according to the present invention is summarized as follows.

First, dimples are arranged on each side (dividing line) of the deformed spherical triangle so that each dimple is bisected by the dividing line and the dimples are arranged consecutively (refer to FIG. 2).

Second, dimples are arranged along each connection line segment connecting a vertex of the deformed spherical triangle and a bisecting point of the side facing the vertex of the deformed spherical triangle. One dimple is arranged to be bisected by the connection line segment, the next two dimples are arranged side by side across the connection line segment, and another one dimple is arranged to be bisected by the connection line segment. Such dimple arrangement are alternately performed consecutively (refer to FIG. 1).

As described above, the dimple arrangement is performed based on the line segments, and after that, appropriately-sized dimples are arranged to be filled in the remaining areas.

FIG. 9 illustrates the dimple arrangement described above. In FIG. 9, a dimple arrangement of the golf ball according to the present invention viewed from the pole side is illustrated.

Figure 10:
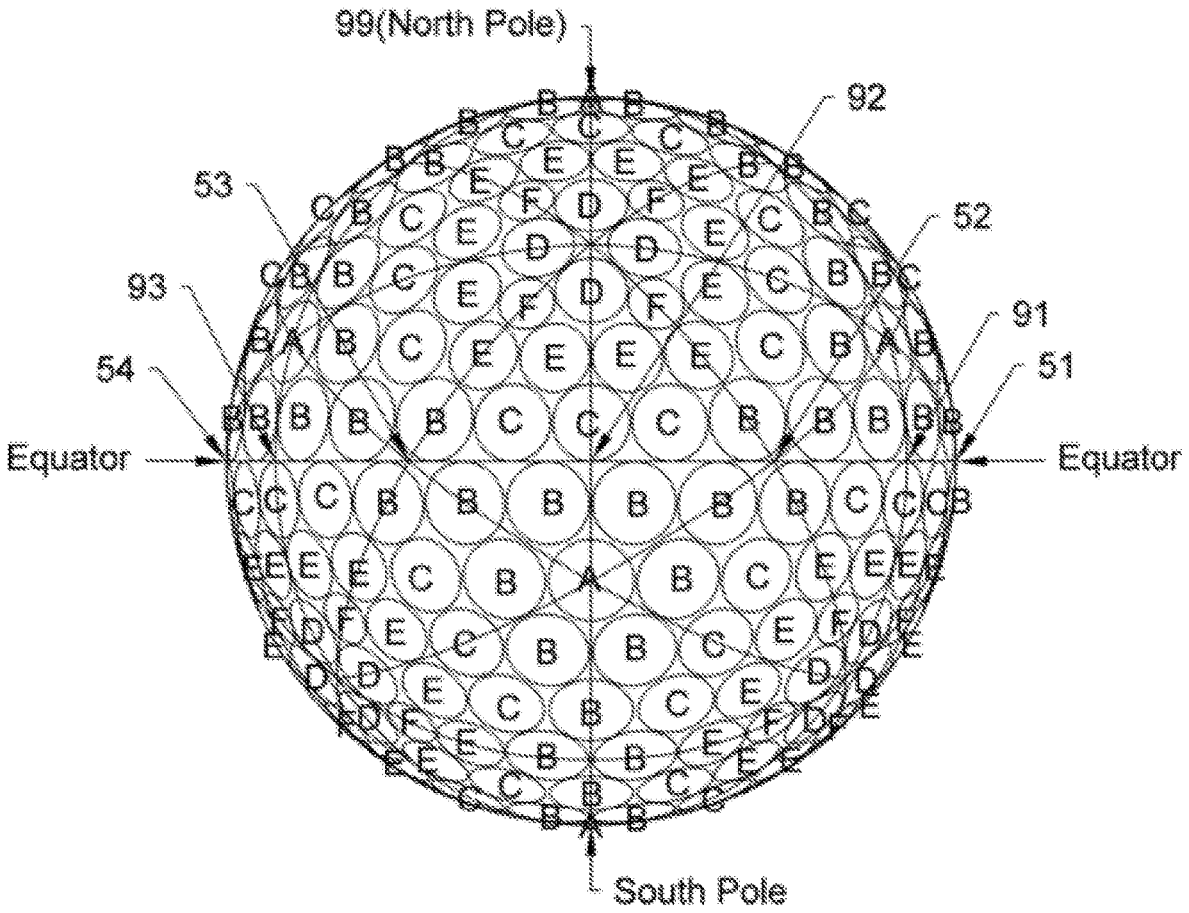
FIG. 10 illustrates a size-based dimple arrangement according to the present invention illustrated in FIG. 9 where dimples are arranged on a spherical quasi-octahedron as viewed from the equator side, with new dividing line segments passing through the equator.
Figure 11:
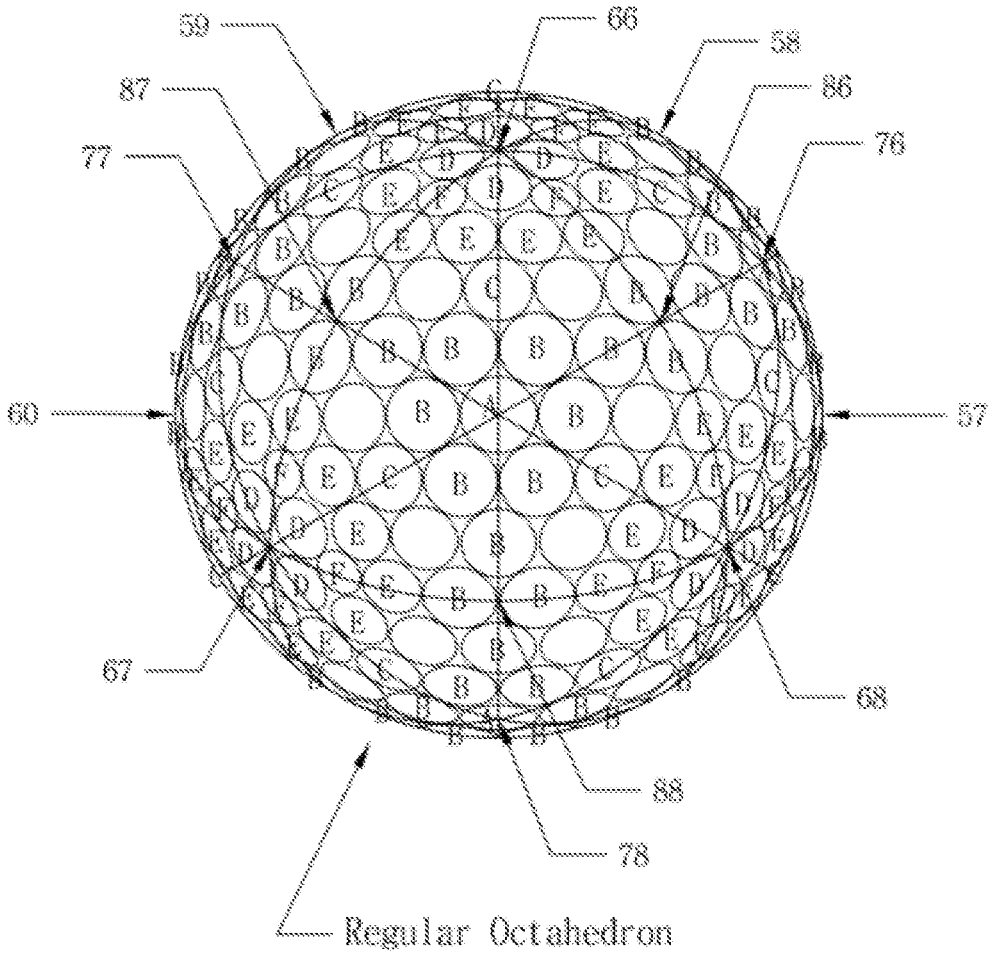
FIG. 11 illustrates a comparison between the size-based dimple arrangement on the dividing structure of the spherical quasi-octahedron according to the present invention and the dimple arrangement on the dividing structure of the spherical octahedron of the prior art. It can be understood that, if the dimple arrangement on the spherical quasi-octahedron based on the sizes of the dimples is implemented at the same positions as those of the dividing structure of the spherical octahedron of the prior art, the dimples are not accurately divided by regular great circles, that is, dividing lines, and in particular, the dimples are arranged in a non-uniform (asymmetric) manner in the lands where dimples are not arranged.

FIG. 10 illustrates a dimple arrangement, as viewed from the equator, obtained by rotating the dimple arrangement viewed from the pole side by 90 degrees. Referring to FIG. 10, in the dimple arrangement based on the sizes of the dimples, dividing lines are formed based on the symmetry to generate a spherical quasi-octahedron, and dimples having larger diameters are arranged on the line segments passing through the bisecting points (connection point of the two line segments) of the dividing line and a dividing line as the side at the vertex.

Figure 12:
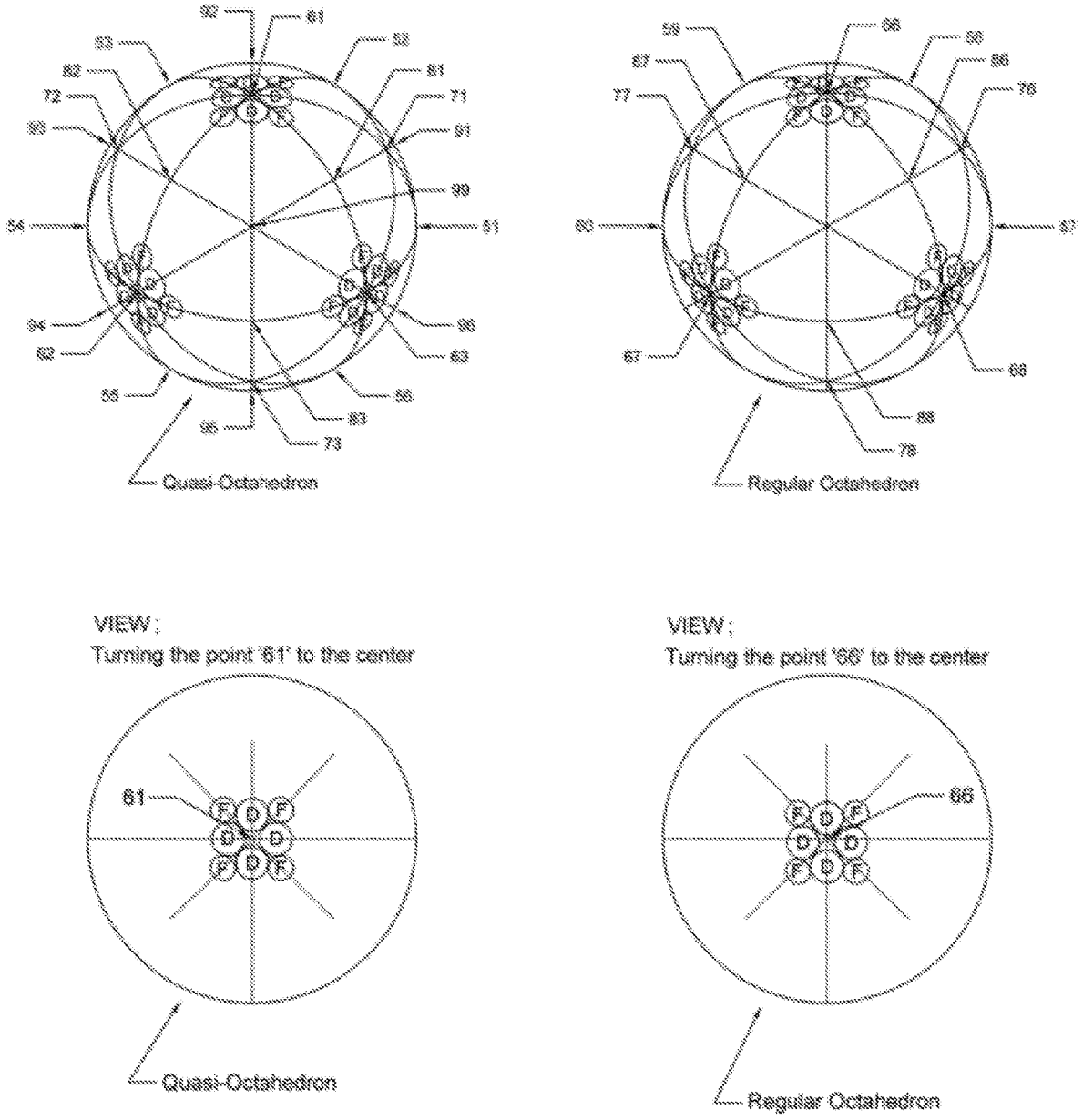
FIG. 12 illustrates the spherical quasi-octahedron according to the present invention where the common vertex of the deformed spherical triangles formed by the dividing lines is allowed to be at the center of the sphere by rotating the common vertex, so that the dimples surrounding the vertex are symmetrically arranged, and the lands surrounding the vertex are also symmetrically arranged. In contrast, with respect to the spherical octahedron of the prior art, it can be understood that, even if the common vertex of the spherical equilateral triangles formed by the dividing lines is allowed to be at the center of the sphere by rotating the common vertex, the dimples around the vertex are not arranged symmetrically, and the lands are not also arranged symmetrically. All of the arranged dimples have the same diameter and are arranged at the same positions on the surface of the sphere.

FIG. 12 illustrates the comparison of the symmetry between the dimple arrangement on the spherical quasi-octahedron according to the present invention and the dimple arrangement on the spherical octahedron of the prior art. As illustrated in FIG. 12, with respect to the spherical quasi-octahedron according to the present invention, it can be understood that, by rotating one vertex of the deformed spherical triangle of the spherical quasi-octahedron, that is, Point 61 (latitude: 36.52 degrees, longitude: 90 degrees) by an angular distance from the pole (Point 99) to the vertex, the vertex is allowed to be at the center of the sphere, so that the four D dimples at the rotated positions are symmetrically arranged around Point 61. In addition, since the land formed at the above position is also equally quadrisected by the dividing lines, it can be understood that the four D dimples can be affected by the same effect during flight.

In contrast, with respect to the spherical octahedron of the prior art, it can be understood that, by rotating one vertex of the spherical equilateral triangle of the spherical octahedron, that is, Point 66 (latitude: 35.2643902 degrees, longitude: 90 degrees) by an angular distance from the pole to the vertex of the spherical equilateral triangle so as to allow the point to be at the center of the sphere, the four D dimples at the rotated positions are asymmetrically arranged around Point 66. In addition, it can be understood that the lands are also unevenly divided by the dividing lines constituting a regular spherical octahedron.

Therefore, in order to symmetrically arrange the dimples having a large diameter according to the present invention on the spherical equilateral triangles of the spherical octahedron of the prior art, there are problems in that the dimples are not accurately bisected by the dividing lines of the spherical equilateral triangles or only a portion of the dimples are arranged to cross the dividing lines, so that the symmetry is degraded.

The dimple arrangement of the golf ball is aerodynamically directly involved with the lift force, and thus, the dimple arrangement greatly affects trajectory and flying stability. The spherical quasi-octahedron according to the present invention eliminates the problem of the symmetry caused by large dimple diameters exceeding a certain diameter formed on the regular spherical octahedron, and thus, it is possible to obtain an effect of improving the flying stability of the golf ball.

The specific embodiments described herein are representative of preferred embodiments or examples according to the present invention, and thus the scope of the invention is not limited thereto. It will be apparent to those skilled in the art that modifications and other uses of the invention do not depart from the scope of the invention described in the claims.

What is claimed is:

1. A golf ball comprising a surface on which dimples and lands are symmetrically arranged within an imaginary, spherical quasi-octahedron, wherein the imaginary, spherical quasi-octahedron is configured to have a northern hemisphere and a southern hemisphere, wherein the northern hemisphere is configured to have an arbitrary one point of the golf ball as a north pole, an imaginary, polar deformed spherical triangle which has, as three sides, a first line segment connecting a line segment starting from a point 51 (latitude: 0 degrees, longitude: 0 degrees) on an equator, passing through a point 63 (latitude: 36.52 degrees, longitude: 330 degrees), and extending to a point 83 (latitude: 54.92 degrees, longitude: 270 degrees) and a line segment starting from a point 54 (latitude: 0 degrees, longitude: 180 degrees) on the equator, passing through a point 62 (latitude: 36.52 degrees, longitude: 210 degrees), and extending to a point 83 (latitude: 54.92 degrees, longitude: 270 degrees) at the point 83, a second line segment connecting a line segment starting from a point 52 (latitude: 0 degrees, longitude: 60 degrees) on the equator, passing through a point 61 (latitude: 36.52 degrees, longitude: 90 degrees), and extending to a point 82 (latitude: 54.92 degrees, longitude: 150 degrees) and a line segment starting from a point 55 (latitude: 0 degrees, longitude: 240 degrees) on the equator, passing through a point 62 (latitude: 36.52 degrees, longitude: 210 degrees), and extending to a point 82 (latitude: 54.92 degrees, longitude: 150 degrees) at the point 82, and a third line segment connecting a line segment starting from a point 53 (latitude: 0 degrees, longitude: 120 degrees) on the equator, passing through a point 61 (latitude: 36.52 degrees, longitude: 90 degrees), and extending to a point 81 (latitude: 54.92 degrees, longitude: 30 degrees) and a line segment starting from a point 56 (latitude: 0 degrees, longitude: 300 degrees) on the equator, passing through a point 63 (latitude: 36.52 degrees, longitude: 330 degrees), and extending to a point 81 (latitude: 54.92 degrees, longitude: 30 degrees) at the point 81 and includes the north pole at the center thereof, and three imaginary, equatorial deformed spherical triangles, each of which is provided to have one side shared with the imaginary, polar deformed spherical triangle and two sides bisected by the equator, wherein the southern hemisphere is configured so as to have one imaginary, polar deformed spherical triangle and three imaginary, equatorial deformed spherical triangles in the same manner as the northern hemisphere, and wherein a dimple haying the largest diameter is arranged at the center of the each polar and equatorial imaginary, deformed spherical triangles.

2. The golf ball according to claim 1, wherein the dimple arrangement on the line segment connecting each vertex of the imaginary, polar deformed spherical triangle and the bisecting point of the side facing the vertex is such that one dimple is arranged to be bisected by the line segment and two dimples are arranged to be in adjacent with the bisected dimple and to be in adjacent with each other across the line segment, and the dimple arrangement is repeated.

3. The golf ball according to claim 1, wherein the dimples arranged on each side of the imaginary, polar deformed spherical triangle include dimples that are arranged consecutively to be bisected by the side.

4. The golf ball according to claim 1, wherein two dimples having the second largest diameter are arranged to face each other with a bisecting point of the side of the imaginary, polar deformed spherical triangle.

5. The golf ball according to claim 1, wherein one dimple is arranged inside the imaginary, polar deformed spherical triangle so that the dimple is not in contact with any side of the imaginary, polar deformed spherical triangle.

6. The golf ball according to claim 1, wherein dimples having different diameters are arranged in each of the imaginary, deformed spherical triangle.

7. The golf ball according to claim 6, wherein the dimples having different diameters arranged in each of the imaginary, deformed spherical triangle are one or more dimples selected from a group consisting of dimples A having a diameter of 0.2 to 0.2025 inches;

dimples B having a diameter of 0.1925 to 0.195 inches;

dimples C having a diameter of 0.18 to 0.1825 inches;

dimples D having a diameter of 0.17 to 0.1725 inches;

dimples E having a diameter of 0.165 to 0.1675 inches; and dimples F having a diameter of 0.13 to 0.1325 inches.

8. The golf ball according to claim 7, wherein in the dimple arrangement on the line segment connecting each vertex of each of the imaginary, deformed spherical triangles and the bisecting point of the side facing the vertex, one dimple D being located at an interior angle of each of the imaginary, deformed spherical triangles, being bisected by a line segment connecting one vertex of each of the imaginary, deformed spherical triangles and a bisecting point of a side facing the vertex, and being in contact with the vertex;

two E dimples being in adjacent with the one dimple D and being in adjacent with each other across the line segment;

one dimple C being in adjacent with the two dimple E and being bisected symmetrically by the line segment;

two B dimples being in adjacent with the one dimple C and being in adjacent with each other across the line segment;

one dimple A being in adjacent with the two B dimples, being located at the center of each of the imaginary, deformed spherical triangles, and being bisected symmetrically by the line segment;

other two B dimples being in adjacent with the one dimple A and being in adjacent with each other across the line segment;

another dimple B being in adjacent with the other two B dimples and being bisected symmetrically by the line segment; and still other two B dimples being in adjacent with the another dimple B, being in adjacent with each other with an intersection point of the line segment and the side facing the vertex, and being bisected symmetrically by the side facing the vertex are arranged in this order.

9. The golf ball according to claim 7, wherein in the dimple arrangement on the side of each of the imaginary, deformed spherical triangles, two D dimples surrounding one vertex of each of the imaginary, deformed spherical triangles and being in adjacent with each other across the side of each of the imaginary, deformed spherical triangles;

one dimple F being in adjacent with the two D dimples D and being bisected symmetrically by the sides;

one dimple E being in adjacent with the one dimple F and being bisected symmetrically by the side;

one dimple B being in adjacent with the one dimple E, being in adjacent with the bisecting point of the side, and being bisected symmetrically by the side;

another dimple B being in adjacent with the one dimple B, being in adjacent with the bisecting point of the side, and being bisected symmetrically by the side;

another dimple E being in adjacent with the other dimple B and being bisected symmetrically by the side;

another dimple F being in adjacent with the other dimple E and being bisected symmetrically by the side; and other two D dimples being in adjacent with the other dimple F, surrounding another vertex of each of the imaginary, deformed spherical triangle, and being in adjacent with each other across the side are arranged in this order.

10. The golf ball according to claim 7, wherein one dimple C is arranged inside each of the imaginary, deformed spherical triangles.

11. The golf ball according to claim 7, wherein the land at a common vertex of each of the imaginary, deformed spherical triangles is surrounded by the D dimples and is symmetrically divided by the connection line segments of the sides of each of the imaginary, deformed spherical triangles and another connection line segments of line segments connecting a vertex of each of the imaginary, deformed spherical triangles and a bisecting point of the side facing the vertex.

12. The golf ball according to claim 1, wherein the number of the dimples is 290 to 320.

* * * * *